US005119630A

United States Patent [19]

Matijas

[11] Patent Number: 5,119,630

[45] Date of Patent: Jun. 9, 1992

[54] PROCESS FOR THE TREATMENT OF SOOT PARTICLES AND THE CLEANING OF EXHAUST GASES OF AN INTERNAL COMBUSTION ENGINE AND APPARATUS FOR ITS PRACTICE

[76] Inventor: Jovan Matijas, Wasserburgertalstr. 4a, D-7701 Muhlhausen-Ehingen, Fed. Rep. of Germany

[21] Appl. No.: 381,633

[22] PCT Filed: Jul. 29, 1988

[86] PCT No.: PCT/DE88/00470

§ 371 Date: Jan. 8, 1990

§ 102(e) Date: Jan. 8, 1990

[87] PCT Pub. No.: WO89/01088

PCT Pub. Date: Feb. 9, 1989

[30] Foreign Application Priority Data

Aug. 3, 1987 [DE] Fed. Rep. of Germany ..... 3725657
Jan. 8, 1988 [DE] Fed. Rep. of Germany ..... 3800277

[51] Int. Cl.[5] ..... F01N 3/02

[52] U.S. Cl. ..... 60/274; 60/275; 60/297; 60/303; 422/170; 422/174

[58] Field of Search ..... 60/303, 274, 275, 297; 422/170, 171, 174

[56] References Cited

U.S. PATENT DOCUMENTS

| | | | |
|---|---|---|---|
| 4,404,795 | 9/1983 | Oishi | 60/303 |
| 4,450,682 | 5/1984 | Sato | 60/303 |
| 4,649,703 | 3/1987 | Dettling | 60/275 |
| 4,852,349 | 8/1989 | Abthoff | 60/303 |

*Primary Examiner*—Douglas Hart
*Attorney, Agent, or Firm*—Herbert L. Lerner; Laurence A. Greenberg

[57] ABSTRACT

Heretofore, soot particles are removed from exhaust gases of an internal combustion engine by means of a ceramic filter, which must periodically be replaced, namely, each time it is used up. The new apparatus is to remove soot particles continually from the exhaust gases without diminishing the filtering action. In a two-part casing there are provided for the exhaust gases, in a first casing half with the inlet and in a second casing half with the outlet, a first deflector chamber for the exhaust gases. In the first casing half there is located a quiescent zone for the exhaust gases and—surrounded by the two casing halves—a heating system which is flown through three times by the exhaust gases. The apparatus produces a strong combustion of the soot particles present in the exhaust gases and is not subject to any exhaustion, since it does not store soot particles but burn the same as much as possible.

25 Claims, 3 Drawing Sheets

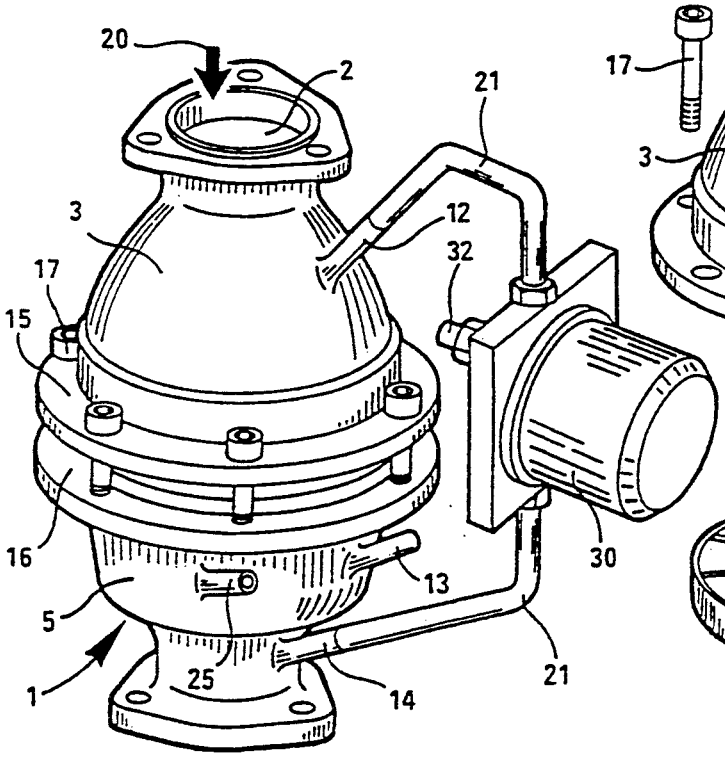
Fig.1
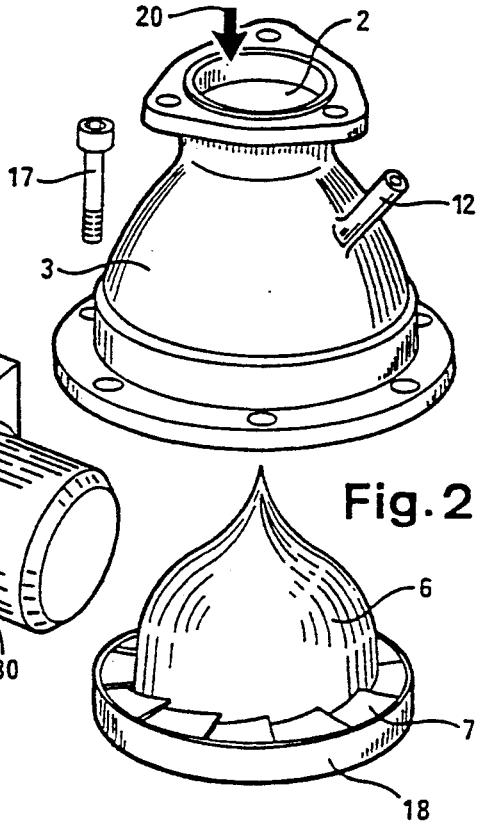
Fig.2
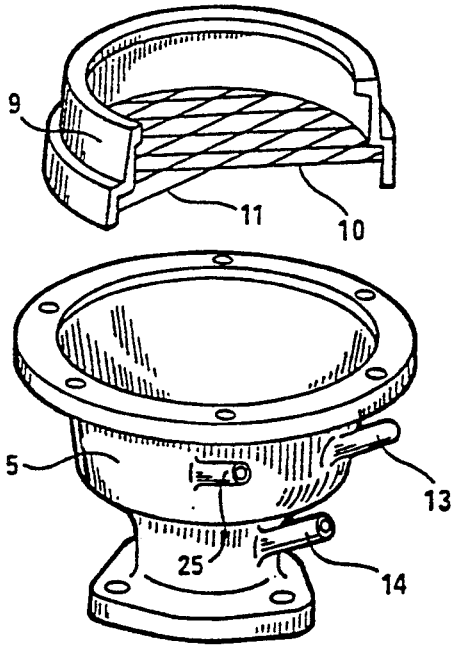

PROCESS FOR THE TREATMENT OF SOOT PARTICLES AND THE CLEANING OF EXHAUST GASES OF AN INTERNAL COMBUSTION ENGINE AND APPARATUS FOR ITS PRACTICE

The invention relates to a process for the treatment of soot particles and the cleaning of exhaust gases of an internal combustion engine and an apparatus for its practice.

West German Laid-open Application 3,502,448 discloses an apparatus for the removal of soot particles and other solid particles from the exhaust gas of motor vehicles, which apparatus contains a soot collector that must be freed of soot through a disposal nozzle. This apparatus has the disadvantage that it is not operative if the soot collector has become completely filled with soot. The soot collector must be cleaned out periodically and results in downtimes for the vehicle concerned.

The object of the invention is to provide a process and an apparatus of the type mentioned in the introduction, with which it is possible continuously to remove soot particles from the exhaust gas of an internal combustion engine and to clean the exhaust gas without the necessity of periodically cleaning a filter.

The invention has the advantage over the prior art in that, during operation of the internal combustion engine concerned, its exhaust gases are continuously freed of soot particles, whereby a filter for residual soot particles becomes filled with soot only after long operating periods. The process brings about and the apparatus permits the elimination of the soot particles and thereafter the destructive oxidation of the residual hydrocarbon groups and combustion of the carbon monoxide into carbon dioxide, so that only water vapor, $H_2O$, and carbon dioxide, $CO_2$, are left as exhaust-gas constituents.

Further advantageous modifications of the invention will become apparent from the claims and the ensuing description.

The invention will be explained with reference to practical embodiments in conjunction with the drawings, in which FIG. 1 is a perspective view of the apparatus in assembled condition;

FIG. 2 is a perspective exploded diagram of the apparatus;

Figure 3:
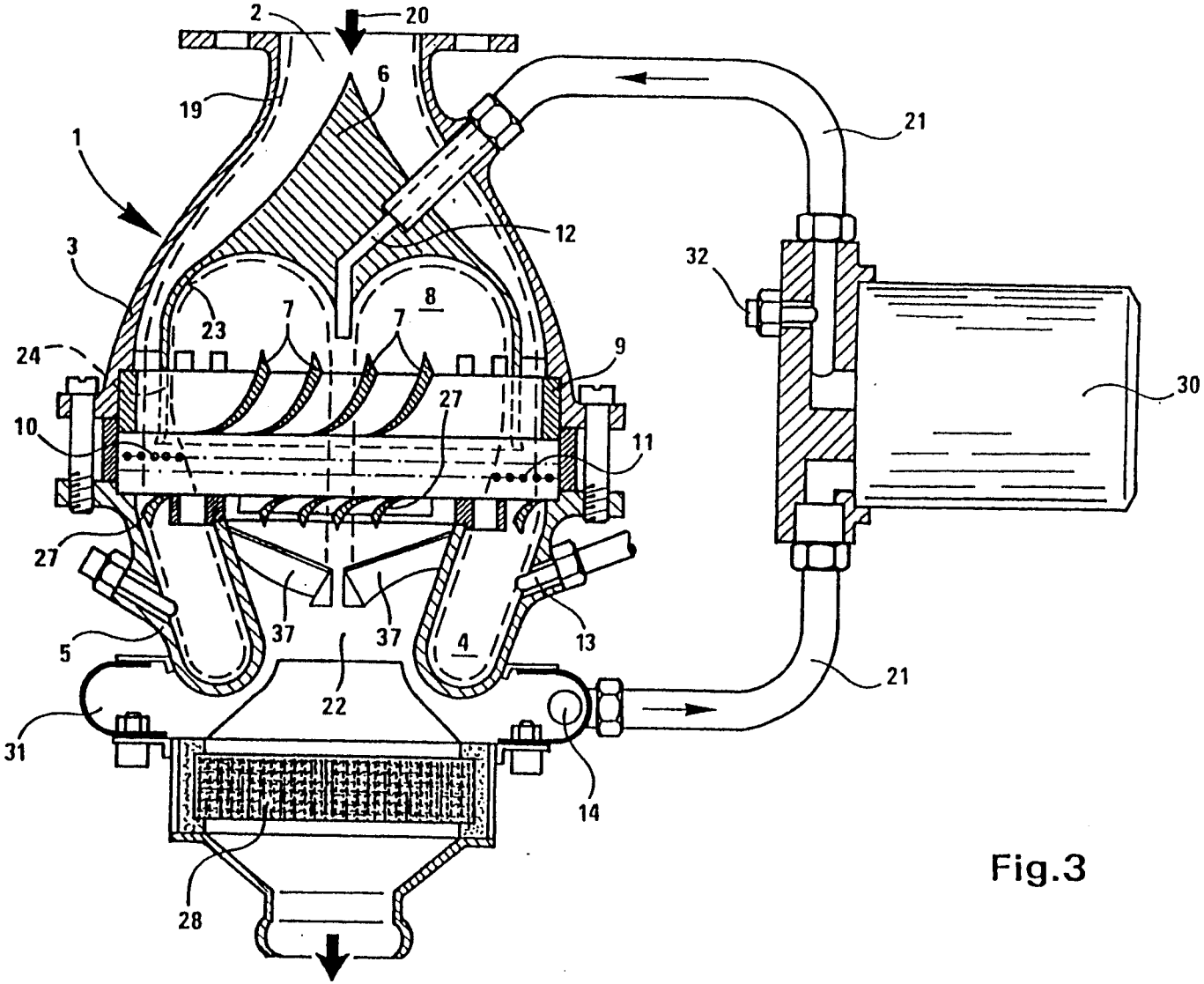
FIG. 3 is a section through the apparatus in assembled condition.

The apparatus contains, first, a casing 1 (FIG. 1), which consists of two casing halves 3, 5 held together by means of flanges 15, 16 and bolts 17. Here, bores with a diameter somewhat larger than that of the bolts are provided in one of the flanges 15. The bolts 17 sit loosely, i.e., with play, in the bores. In the other flange 16, threaded holes are provided into which the bolts 17 are screwed.

Before the two casing halves 3, 5 are brought together, a heating ring 9 (FIG. 2) and a flow cone 6 are inserted in the casing 1.

Figure 4:
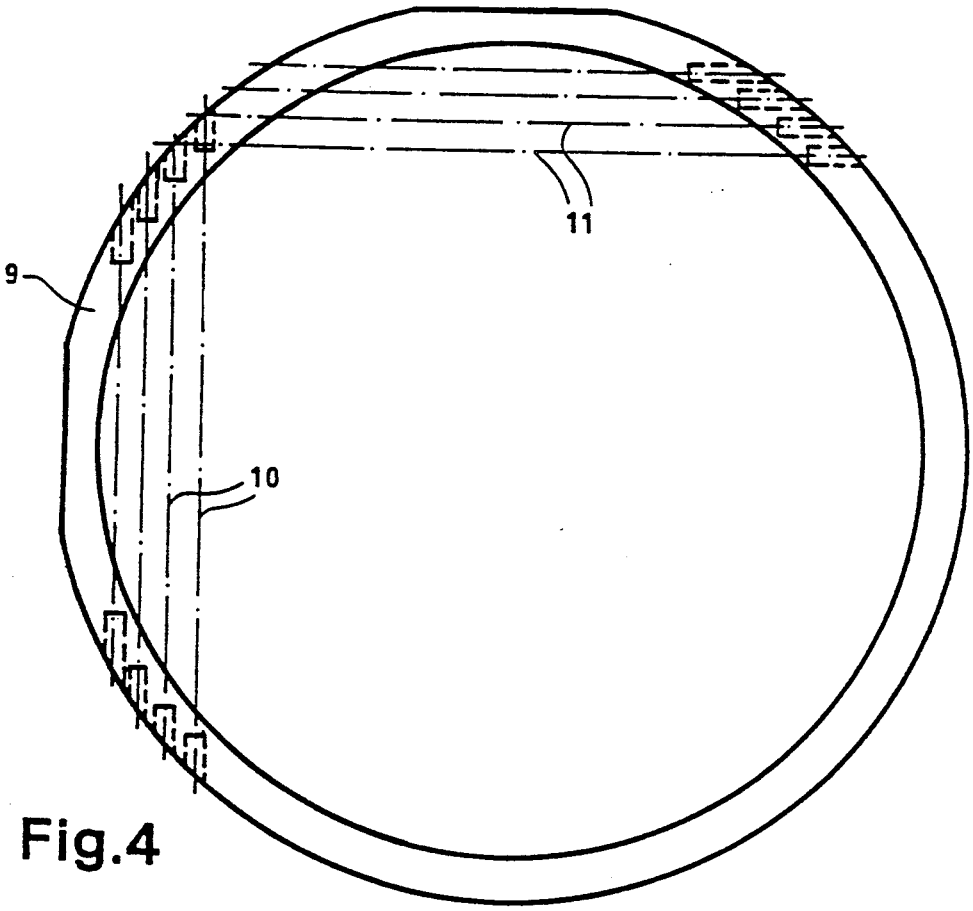
FIG. 4 is a top plan view of a heating ring associated with the apparatus.

The first casing half 3 (FIG. 3) has an inlet 2 and the second casing half 5 has an outlet 22 for the exhaust gases. The flow cone 6 of the apparatus is inserted in the casing 1 such that its tip points toward the exhaust gases flowing in through the inlet 2 of the apparatus. Gas deflector plates 7 are provided at one edge 18 (FIG. 2) of the flow cone 6. Exhaust gases arriving in the direction of arrow 20 (FIG. 3) along a streamline 19 pass the inlet 2, the space formed between the flow cone 6 and the wall of the upper casing half 3, and the gas deflector plates 7 (FIG. 3). The gas deflector plates 7 cause the exhaust gases to be swirled in a circular path along the outer wall of the casing 1. The exhaust gases then pass through the electrically heated heating wires 10, 11, (FIGS. 2, 3, 4), clamped in the heating ring 9, at an angle to the gap between the heating wires 10 and the heating wires 11, after which they arrive in a first deflection chamber 4 in the second casing half 5. There, they impinge upon the outer wall of the second casing half 5 and, still swirling in a circular path corresponding to the outer wall of the second casing half 5, are deflected in the first deflection chamber 4. The exhaust gases are also directed toward the outer wall of the second casing half 5, since they are deflected beforehand toward the outer wall of the second casing half 5 by an edge 24 spread gradually outward on the flow cone 6 .

After deflection of the exhaust gases in the deflection chamber 4, they are passed for the second time — again at an angle — through the heating wires 10, 11 clamped and heated in the heating ring 9, and arrive at the inner surface 23 of the flow cone 6, where they are deflected — while still being swirled in a circular ring — and passed from here for the third time — again at an angle — through the heated heating wires 10, 11.

Because the exhaust gases and especially the soot particles pass through the heated heating wires 10, 11 three times and in the process sweep past the heating wires at an angle, intensive heating of the soot particles, which burn well as a result (pyrolysis), is achieved.

A line 12 leads from the inside of the flow cone 6 out of the first casing half 3. The area in which the line 12 discharges into the deflection chamber 8 in the flow cone 6 constitutes a quiescent zone for the exhaust gases. From here, residues that remain after the three-stage combustion can be sucked out of the casing 1. This is accomplished through a line 21 (FIGS. 1, 3), which is connected to a duct 14 in a space 31 (FIG. 3) disposed downstream from the outlet of the casing 1. A soot filter 30, preferably in the form of a replaceable filter cartridge, is interposed in the line 21.

During operation of the apparatus, an overpressure develops in the duct 14, so that combustion residues, i.e., soot particles, still present at the outlet 22 are conveyed through the line 21 to the soot filter 30 and deposited thereat. It can be replaced if the soot filter 30 is saturated with soot particles and other combustion residues. A sensor 32 connected, for example, to an electronic system (not shown in the drawings), can monitor the degree of saturation of the soot filter 30.

A duct 13 is used to supply fresh air, which is necessary when the engine adjustment is too rich. The supply of air into the deflection chamber 4 promotes the second and third combustion of the soot particles by the heating wires 10, 11. The control of the air supply to the duct 13, and thus to the deflection chamber 4, is provided by means known in themselves. Through another line 25 (FIGS. 1, 2), which also opens into the deflection chamber 4, a sample of the exhaust-gas stream can be taken directly from the deflection chamber 4 and its condition checked by means of a sensor.

Gas deflector plates 27 are also provided in the area of the casing half 5 (FIG. 3) for the purpose of swirling well the exhaust gases, which also entrain soot particles. Other gas deflector plates 37 are installed centrally upstream from the outlet.

Figure 5:
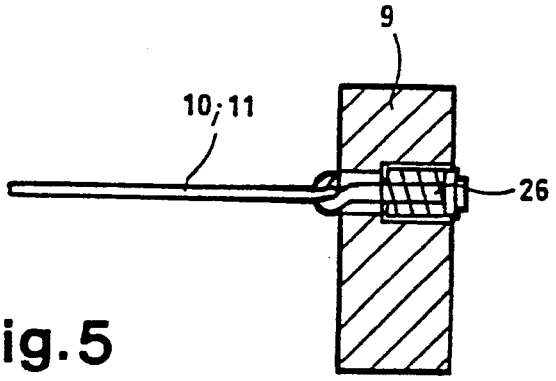
FIG. 5 is a view of a stay for a heating wire.

The heating ring 9 bearing the heating wires 10, 11 consists of refractory ceramic material. In the practical embodiment, the heating wires 10, 11 are clamped between spring-loaded stays 26 (FIG. 5). The spring-loaded stays 26 compensate for changes in length of the heating wires 10, 11 due to varying temperatures.

In one practical embodiment, the heating wires 10, 11 have developed temperatures of between 700 and 800° C.

The gas deflector plates 7 in one practical embodiment are inclined with an angle of attack of approximately 22° C. with respect to the planes in which the heating wires are located.

In another practical embodiment, the inclination of all gas deflector plates 7, 27, 37 can be changed if necessary, e.g., by bending the gas deflector plates.

The exhaust gases emerge from the casing 1 through its outlet 22 and arrive at an exhaust-gas filter 28 which is known in itself, for example, a catalyst in the form of a monolithic element.

The operation of an internal combustion engine in conjunction with the described apparatus can be achieved, first, by supplying the ignition electrodes, i.e., the heating wires 10, 11, with current, thereby heating them up to high temperature. Only then will the internal combustion engine be started, thus ensuring excellent treatment and filtering-out of the soot particles as well as thorough cleaning of the exhaust gases.

The process for the treatment of soot particles and cleaning of exhaust gases of an internal combustion engine consists in moving exhaust gases containing soot particles past one or more ignition electrodes heated up to high temperature in order to burn said soot particles, feeding remaining soot particles to a soot filter, and passing the exhaust gases through an exhaust-gas filter. The exhaust gases which first entrain the soot particles are given a rotary motion so as to remove the same, and the soot particles are concentrated three-dimensionally by the action of centrifugal forces and, optionally, of a quiescent in-flowing zone or zones disposed in the flow path, and are passed from there to a soot filter. To initiate the combustion of newly arriving soot particles which are to be burned, one uses, instead of ignition electrodes, the heat of reaction of the already-burning soot particles and/or of the apparatus for carrying out the process, which has been heated up to high temperature.

I claim:

1. A process for the treatment of soot particles and the cleaning of exhaust gases of an internal combustion engine, which comprises: sweeping the exhaust gases with the soot particles past a plurality of ignition electrode wires heated up to high temperature for burning the soot particles, concentrating the soot particles by giving the exhaust gases extraining the soot particles a rotary motion, feeding remaining soot particles to a soot filter, and passing the exhaust gases through an exhaust filter.

2. The process according to claim 1, which comprises providing a quiescent zone in the flow path of the exhaust gas, and concentrating the soot particles in the quiescent zone.

3. A process for the treatment of soot particles and the cleaning of exhaust gases of an internal combustion engine, which comprises: burning the soot particles entrained in the exhaust gases by utilizing the heat of reaction of burning soot particles, concentrating remaining soot particles by giving the exhaust gases entraining the soot particles a rotary motion, feeding remaining soot particles to a soot filter, and passing the exhaust gases through an exhaust filter.

4. The process according to claim 3, which comprises providing an apparatus for cleaning the exhaust gases in the form of a casing having an inlet, an outlet and gas deflector plates disposed in said housing, initiating the burning of newly arriving soot particles which are to be burned by utilizing the heat of reaction of the already burning soot particles and the heat of the apparatus for cleaning the exhaust gas after the apparatus has been heated up to high temperature.

5. An apparatus for cleaning soot particles from exhaust gases of internal combustion engines, comprising a casing having an inlet, an outlet and a central region, an ignition electrode wire mounted in said casing for burning soot particles, gas deflector plates for swirling the exhaust gases about said central region and for concentrating the soot particles in said central region, filter means disposed outside said central region for filtering soot particles, and means for withdrawing the soot particles from said central region and feeding to said filter means.

6. The apparatus according to claim 5, wherein said casing defines a central longitudinal axis and includes a first casing half having said inlet and a second casing half having said outlet, including a first deflection chamber, disposed in said casing, a flow cone disposed coaxially in said casing, said flow cone having gas deflector plates and a second deflection chamber, an ignition electrode, wire for burning soot particles, and an exhaust gas filter fitted downstream from said casing as seen in the flow direction of the exhaust gas.

7. The apparatus as set forth in claim 6, wherein the second casing half (5) too is provided with gas deflector plates (17) in an annular space (29).

8. The apparatus as set forth in claim 6, wherein the second casing half (5) has further gas deflector plates (37, which are disposed in the center of the second casing half (5).

9. The apparatus as set forth in claim 7, wherein the casing (1) has a substantially rotation-symmetrical shape.

10. The apparatus as set forth in claim 9, including a heating ring disposed in a plane in which said two casing halves are connected to each other, said electrode wire being disposed in said heating ring.

11. The apparatus as set forth in claim 10, wherein there are provided in the heating ring (9) a first group of heating wires (10) running parallel to one another and a second group of heating wires (11) running parallel to one another, and the first group is disposed in the direction of flow upstream from the second group.

12. The apparatus as set forth in claim 11, wherein the two groups of heating wires (10, 11) are offset relative to the longitudinal axes of the heating wires.

13. The apparatus as set forth in claim 12, wherein the longitudinal axes of the heating wires (10, 11) are placed at right angles.

14. The apparatus as set forth in claim 13, wherein a duct (12) is provided which from the interior of the flow cone (6) is brought out of the first casing half (3).

15. The apparatus as set forth in claim 14, wherein a duct (13) running to the outside is located in the second casing half (5) and is in flow communication with the first deflection chamber (4).

16. The apparatus as set forth in claim 15, wherein there is provided in the second casing half (5) a duct (14) running from the outlet (22) to the outside and disposed transversely to the outlet (22).

17. The apparatus as set forth in claim 16, wherein the line (22) emerging from the second deflection chamber (8) is connected via an external line (21) to a line (14) running to an outlet (22) of the casing (1).

18. The apparatus as set forth in claim 17, wherein a free edge (24) of the flow cone (6) is spread gradually outward.

19. The apparatus as set forth in claim 18, wherein the inclination of the gas deflector plates (7, 27) can be adjusted to the planes of the heating wires (10, 11).

20. The apparatus as set forth in claim 19, wherein said filter means is a soot filter attached between the outer ends of the ducts.

21. The apparatus as set forth in claim 20, wherein there lies in each of the circuits of the heating wires (10, 11) of the heating ring (9) a switch which is operated by a control electronic system for the temperature-dependent switching on and off of the circuit concerned.

22. The apparatus as set forth in claim 21, wherein, instead of heating wires, a duct-type structure with depth effect and composed of one or more substances put on for catalytic action is employed.

23. The apparatus as set forth in claim 22, wherein the exhaust gas filter (28) is a catalyst.

24. The apparatus as set forth in claim 23, wherein the catalyst includes a structure in which also the base material consists only of a catalytically active material.

25. The apparatus as set forth in claim 24, wherein impacting, diffusion or electrostatic deposition are employed to enrich the soot particles.

* * * * *